US007958833B2

(12) United States Patent
Fujihara

(10) Patent No.: US 7,958,833 B2
(45) Date of Patent: Jun. 14, 2011

(54) PRESSER FOOT DEVICE FOR SEWING MACHINE AND SEWING MACHINE PROVIDED THEREWITH

(75) Inventor: Shinya Fujihara, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 348 days.

(21) Appl. No.: 12/285,940

(22) Filed: Oct. 16, 2008

(65) Prior Publication Data

US 2009/0114133 A1 May 7, 2009

(30) Foreign Application Priority Data

Nov. 1, 2007 (JP) ..... 2007-285078

(51) Int. Cl.
*D05B 29/06* (2006.01)
*D05B 29/00* (2006.01)

(52) U.S. Cl. ..... 112/237

(58) Field of Classification Search ..... 112/235–240
See application file for complete search history.

(56) References Cited

U.S. PATENT DOCUMENTS

| | | | | | |
|---|---|---|---|---|---|
| 21,671 | A | * | 10/1858 | Grover | 112/237 |
| 2,422,820 | A | * | 6/1947 | Best | 112/237 |
| 3,494,314 | A | * | 2/1970 | Johnson | 112/238 |
| 4,403,561 | A | * | 9/1983 | Schaeflern et al. | 112/237 |
| 4,709,644 | A | * | 12/1987 | Fujihara et al. | 112/237 |
| 7,325,501 | B2 | | 2/2008 | Yamasaki | |

FOREIGN PATENT DOCUMENTS

| | | |
|---|---|---|
| JP | A-08-057174 | 3/1996 |
| JP | A-2002-066181 | 3/2002 |
| JP | A-2007-229273 | 9/2007 |

* cited by examiner

*Primary Examiner* — Ismael Izaguirre
(74) *Attorney, Agent, or Firm* — Oliff & Berridge, PLC

(57) ABSTRACT

A presser foot device for a sewing machine includes a presser bar mounted on a head provided at a distal end of an arm and having a lower end having a presser foot, the presser foot device lifting the presser foot upward and downward together with the presser bar, the presser foot device further including a first shaft, a support unit configured to support the first shaft, and a presser foot lifting lever configured to move the presser foot upward and downward, the presser foot lifting lever being rotatably connected to the support unit by the first shaft. The support unit is rotatable between a first position where the presser foot lifting lever is located below the arm of the sewing machine and a second position where the presser foot lifting lever is located behind the head of the sewing machine.

11 Claims, 10 Drawing Sheets

PRESSER FOOT DEVICE FOR SEWING MACHINE AND SEWING MACHINE PROVIDED THEREWITH

CROSS-REFERENCE TO RELATED APPLICATIONS

This application is based on and claims the benefit of priority from the prior Japanese Patent Application No. 2007-285078, filed on Nov. 1, 2007, the entire contents of which are incorporated herein by reference.

BACKGROUND

1. Field

The present disclosure relates to a presser foot device for a sewing machine moving a presser foot upward and downward and a sewing machine provided with the presser foot device.

2. Related Art

Conventional household sewing machines generally comprise a bed, a pillar and an arm. A sewing head is provided on a distal end of the arm. A presser bar is mounted on the head so as to be movable upward and downward. The presser bar has a lower end to which a presser foot is attached for pressing workpiece cloth on the bed. A presser foot device is further provided in the head and includes a presser foot lifting lever for lifting the presser foot upward and downward. The presser foot lifting lever is vertically swung by a user so that the presser foot is moved upward and downward together with the presser bar.

For example, Japanese patent application publication, JP-A-2002-66181 (hereinafter, "reference 1"), discloses a sewing machine in which a presser foot lifting lever is disposed in the head so as to protrude into a space surrounded by the bed, pillar and arm (hereinafter, "surrounded space"). Furthermore, Japanese patent application publication, JP-A-H08-57174 (hereinafter, "reference 2"), discloses a sewing machine in which a presser foot lifting lever is disposed on the rear of a head so as to protrude backward as viewed at the front of the sewing machine.

In the sewing machine of reference 1, the presser foot lifting lever is located so as to protrude into the surrounded space. Accordingly, the presser foot lifting lever has a good operability. However, user's hands tend to touch with the presser foot lifting lever when workpiece cloth is treated in the surrounded space during the sewing. Furthermore, when workpiece cloth is large, there is a possibility that the workpiece cloth may spread into the surrounded space thereby to be caught by the presser foot lifting lever. Thus, there is a problem that the presser foot lifting lever becomes a hindrance to the sewing.

On the other hand, the presser foot lifting lever is located in the rear of the head in the sewing machine of reference 2. As a result, the above-described problem encountered in reference 1 can be overcome by reference 2. However, the user necessitates putting his or her hand towards the rear of the sewing machine head in order to operate the presser foot lifting lever. As a result, there is a problem that the presser foot lifting lever has a bad operability.

Thus, it is desired to simultaneously overcome the defects both in the case where the presser foot lifting lever protrudes into the surrounded space and in the case where the presser foot lifting lever protrudes behind the head.

SUMMARY

Therefore, an object of the present disclosure is to provide a presser foot device which has an improved operability and which has a good usability, and a sewing machine provided with the aforesaid presser foot device.

The present disclosure provides a presser foot device for a sewing machine which includes a presser bar mounted on a head provided at a distal end of an arm and having a lower end provided with a presser foot, the presser foot device lifting the presser foot upward and downward together with the presser bar, the presser foot device comprising a first shaft, a support unit configured to support the fisrt shaft, and a presser foot lifting lever configured to move the presser foot upward and downward, the presser foot lifting lever being rotatably connected to the support unit by the first shaft, wherein the support unit is rotatable between a first position where the presser foot lifting lever is located below the arm of the sewing machine and a second position where the presser foot lifting lever is located behind the head of the sewing machine.

According to the above-described construction, the presser foot lifting lever can be switched between the first and second positions according to usage of the lever, size of workpiece cloth or the like. More specifically, the presser foot lifting lever is located at the second position or in the surrounded space when operated for ascent or descent of the presser foot. Consequently, the operability of the presser foot device can be improved. On the other hand, the presser foot lifting lever is switched to the second position or is located on the rear of the head when the workpiece cloth is to be treated or a relatively larger workpiece cloth is to be sewn. Consequently, user's hands can reliably be prevented from touching with the presser foot lifting lever, and the workpiece cloth can reliably be prevented from being caught by the presser foot lifting lever. Furthermore, the operation position of the presser foot lifting lever is switchable between the first and second positions according to user's preference, whereupon the usability of the presser foot device can be improved.

BRIEF DESCRIPTION OF THE DRAWINGS

Other objects, features and advantages of the present disclosure will become clear upon reviewing the following description of one embodiment with reference to the accompanying drawings, in which.

DETAILED DESCRIPTION

Figure 1:
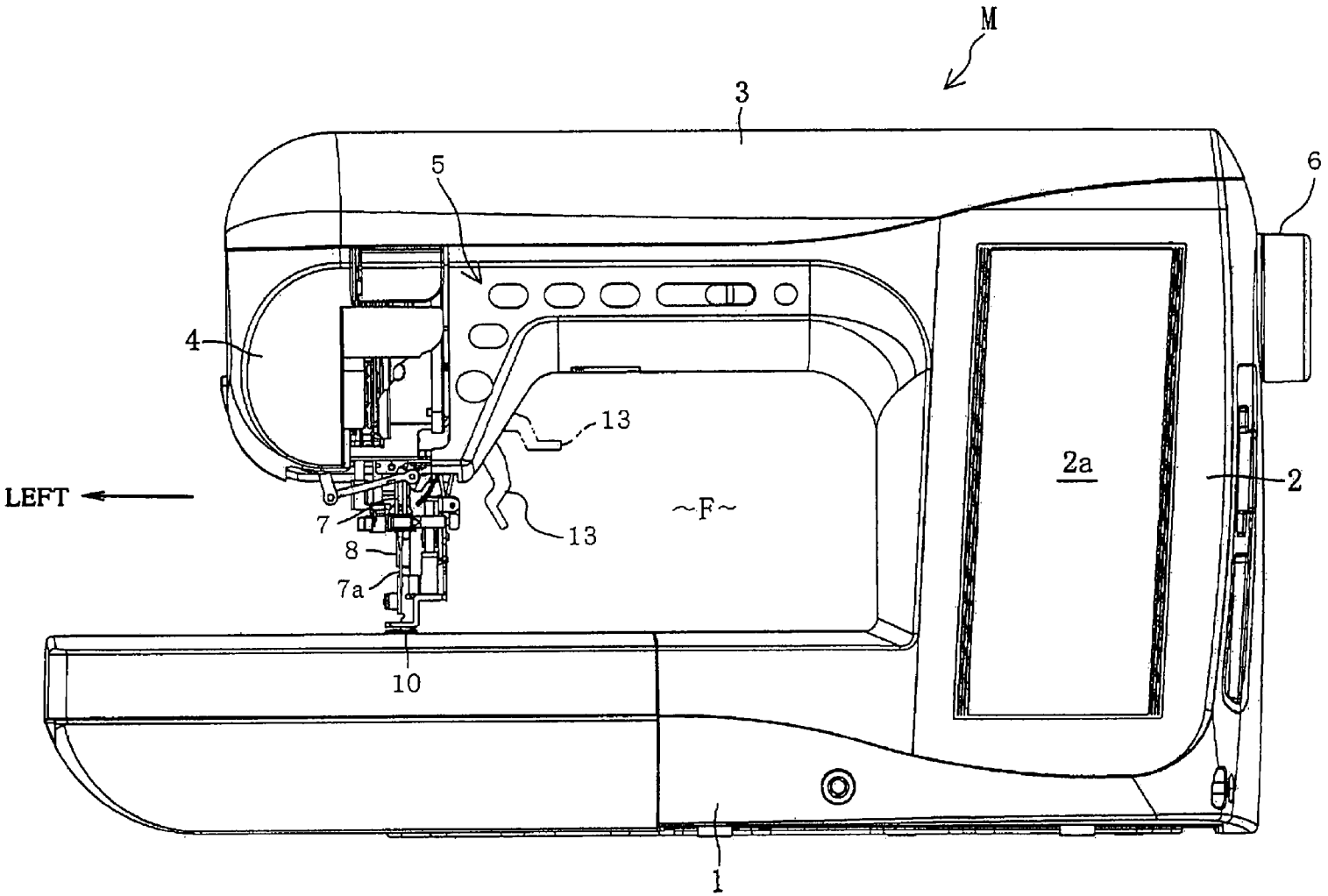
FIG. 1 is a front view of a sewing machine of a first embodiment in accordance with the present disclosure.

A first embodiment will be described with reference to FIGS. 1 to 10B. Referring first to FIG. 1, a sewing machine M similar to a general household sewing machine is shown. The sewing machine M includes a bed 1, a pillar 2 standing upward from a right end of the bed 1, an arm 3 extending leftward from an upper end of the pillar 2 so as to be opposed to the bed 1 and a head 4 provided at a left part or a distal end of the arm 3 as shown in FIG. 1. The bed 1, pillar 2, arm 3 and head 4 are formed integrally with one another. A space defined or surrounded by the bed 1, pillar 2, arm 3 will hereinafter be referred to as "surrounded space" F. The side of the sewing machine M shown in FIG. 1 will be referred to as "front". A vertical liquid-crystal display 2*a* is mounted on the front of the pillar 2. Various switches 5 are mounted on the fronts of the arm 3 and head 4.

A sewing machine main shaft (not shown) is provided in the arm 3 so as to extend in the horizontal direction, and a sewing machine motor (not shown) is also provided for rotating the main shaft. Furthermore, a hand pulley 6 is provided in the arm 3 for manually rotating the main shaft. A needle bar 7 is mounted on the head 4 and has a lower end to which a sewing needle 7*a* (only shown in FIG. 1) is attached. The needle bar 7 is moved upward and downward by a needle bar driving mechanism (not shown) to which rotation of the main shaft is transmitted. The arm 3 further includes a needle swinging mechanism (not shown) which swings the needle bar 7 in the right-and-left direction perpendicular to a cloth feed direction and a needle thread take-up drive mechanism which moves a needle thread take-up (not shown) upward and downward in synchronization with vertical movement of the needle bar 7.

The bed 1 includes a cloth feed mechanism which moves a feed dog in the vertical and front-back directions and a thread cutting mechanism although none of them are shown. The bed 1 further includes a horizontal rotary hook which carries out a sewing work in association with the needle 7*a* while supplying a bobbin thread from a bobbin accommodated therein.

The head 4 includes a presser bar 8 provided so as to be vertically movable. FIGS. 2A, 2B, 3A and 3B show the presser bar 8 and the head 4 as viewed at the right rear of the head. A pair of upper and lower guide members 9*a* and 9*b* (see FIG. 4A) are secured to a sewing machine frame 9 of the head 4. The presser bar 8 includes an upper portion inserted through holes of the guide members 9*a* and 9*b* thereby to be guided so as to be vertically lifted in the rear of the needle bar (see FIG. 2A). The presser bar 8 further includes a lower portion protruding downward from the rear of the head 4. A presser foot 10 is mounted on a lower end of the presser bar 8. A presser bar bracket 11 is fitted substantially with the vertical middle of the presser bar 8, thereby being fixed. A compression coil spring 12 is provided between the presser bar bracket 11 and the upper guide member 9*a* as shown in FIG. 4A. The spring 12 is in abutment with an upper end surface of the presser bar bracket 11 to elastically bias the presser bar 8 downward, thereby pressing the presser foot 10 against a needle plate 1*a* of the bed 1. The head 4 is provided with a presser foot device 14 having a presser foot lifting lever 13 which is operated to lift the presser foot 10. The presser foot lifting lever 13 is swung vertically by the user so that the presser bar bracket 11 and accordingly the presser foot 10 are lifted together with the presser bar 8.

Figure 4A:
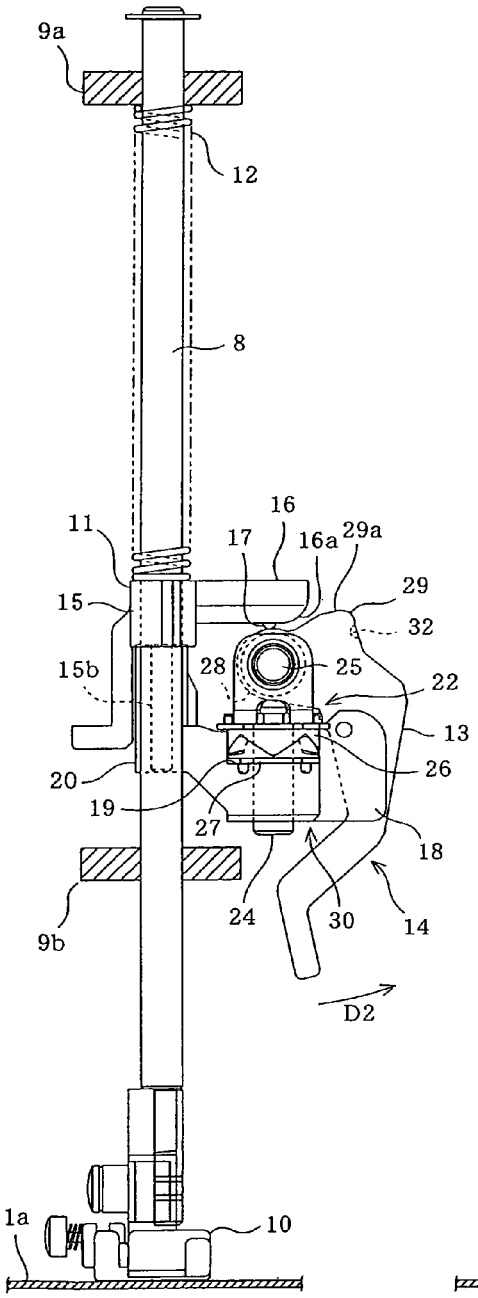
FIGS. 4A and 4B are front views of the presser foot device, presser bar and presser foot when the presser foot lifting lever is located at the descent and ascent positions in the surrounded space, respectively.
Figure 4B:
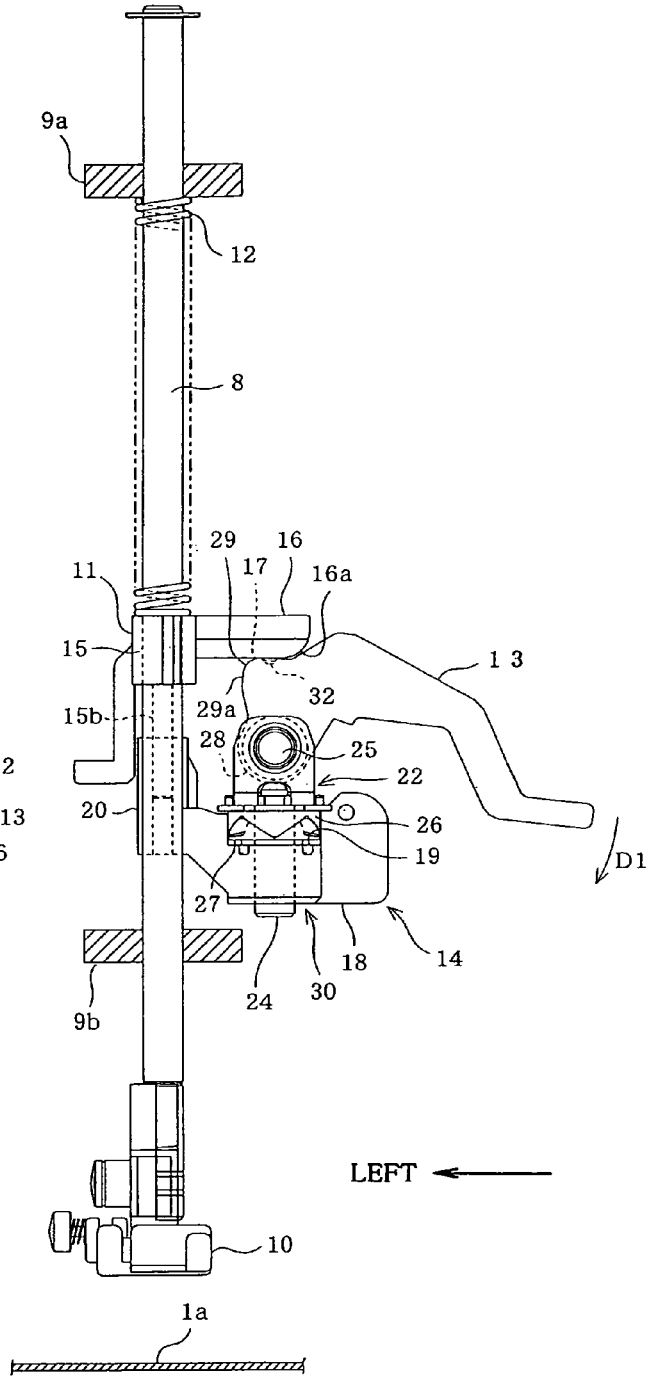
Figure 5A:
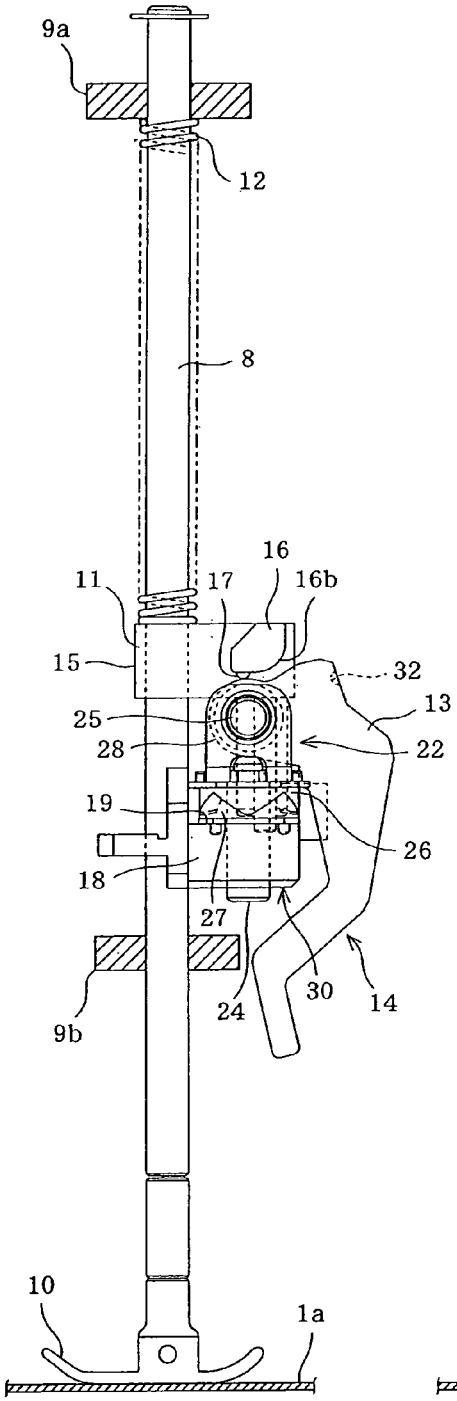
FIGS. 5A and 5B are front views of the presser foot device, presser bar and presser foot when the presser foot lifting lever is located at the descent and ascent positions behind the head, respectively.
Figure 5B:
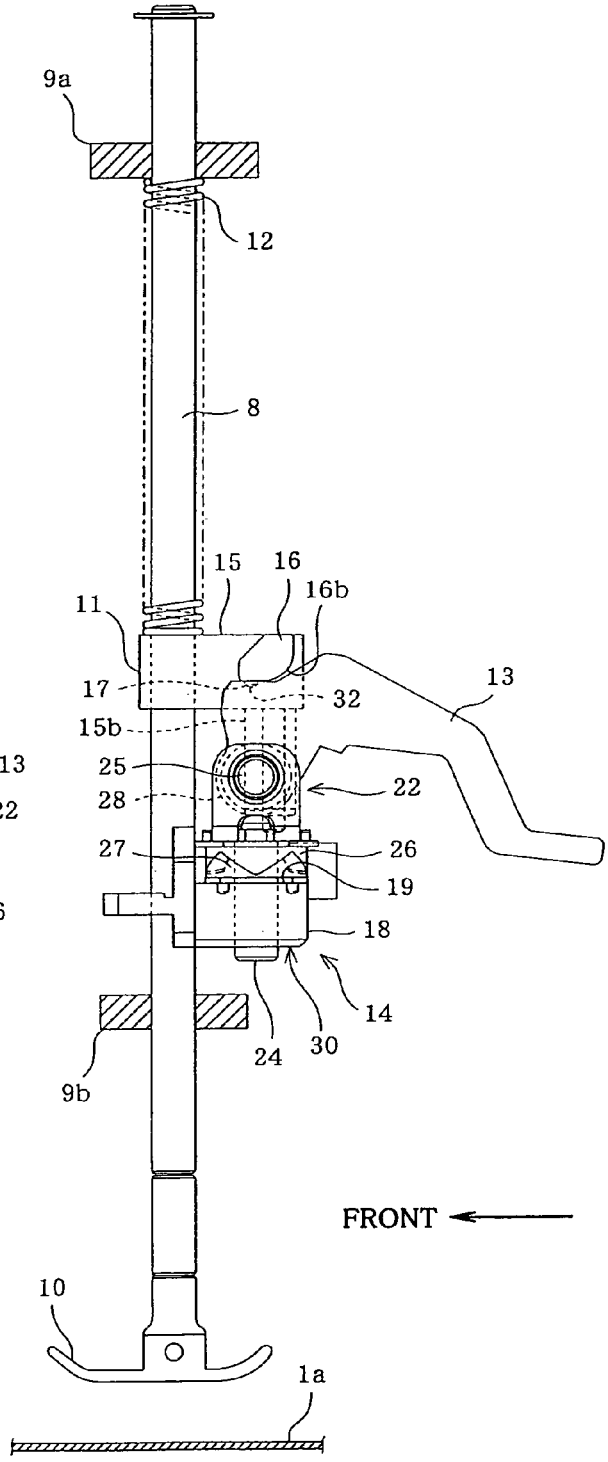
Figure 6A:
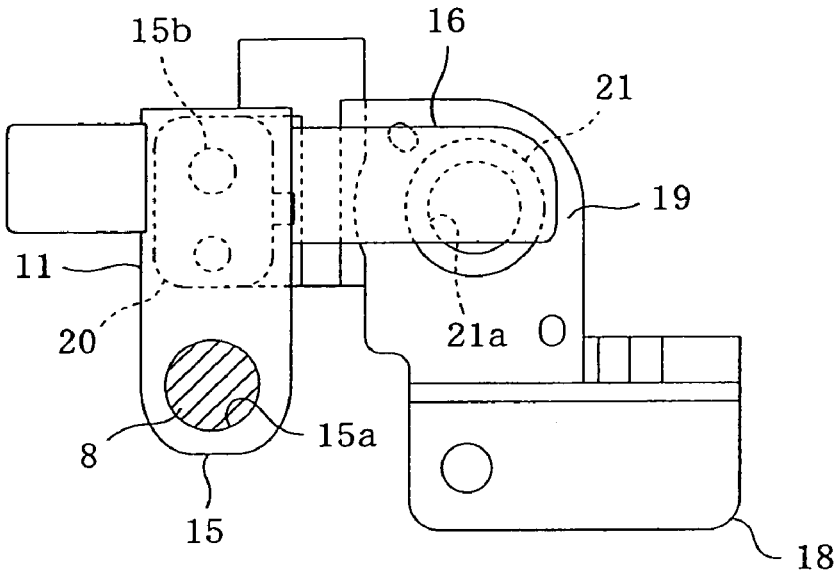
FIGS. 6A and 6B are enlarged plan and front views of a presser bar bracket and mounting members respectively.
Figure 6B:
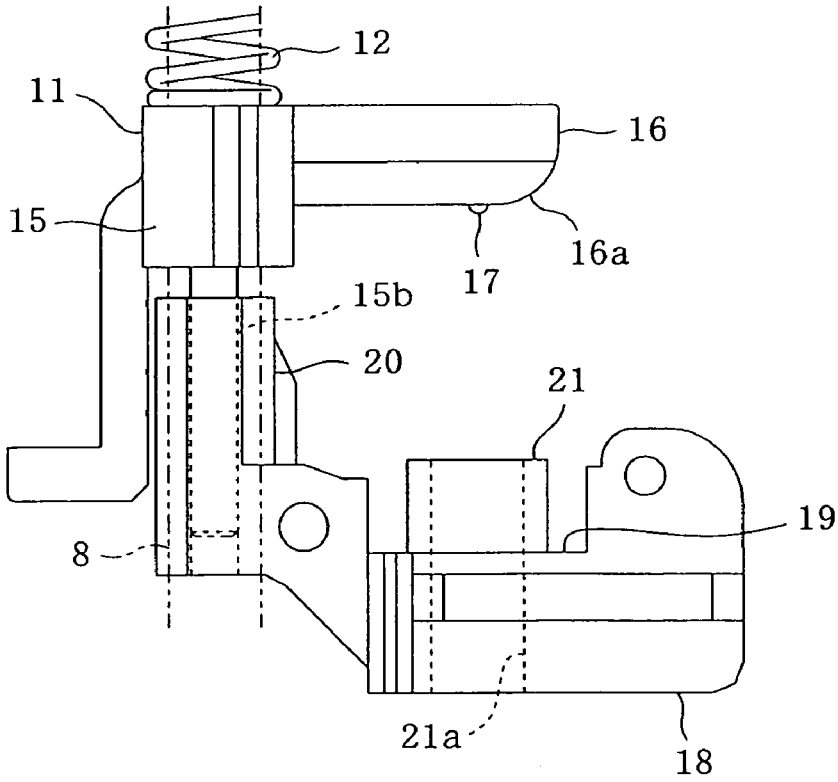

The structure of the presser bar bracket 11 and presser foot device 14 will now be described with reference to FIGS. 6A to 10B. The presser bar bracket 11 has a bracket body 15 extending in the front-back direction and a bracket arm 16 extending rightward from the rear of the bracket body 15 as shown in FIGS. 6A and 6B. The bracket body 15 and the bracket arm 16 are formed integrally with each other. The presser bar bracket 11 is formed into a general L-shape. The bracket body 15 has a front formed with a through hole 15*a* through which the presser bar 8 is inserted and a rear formed integrally with a generally bar-shaped guide shaft 15*b*. The bracket arm 16 has a distal or right end and a rear both formed with arc-shaped cam faces 16*a* and 16*b* which are continuous with each other, as shown in FIGS. 4A and 5A respectively. The bracket arm 16 has a small protrusion-like convex portion 17 which is integrally formed on an underside thereof. The convex portion 17 is located substantially on a center line of a vertical axis 24 (see FIG. 4A and the like) that will be described later. The convex portion 17 serves as an engaged portion.

Figure 2B:
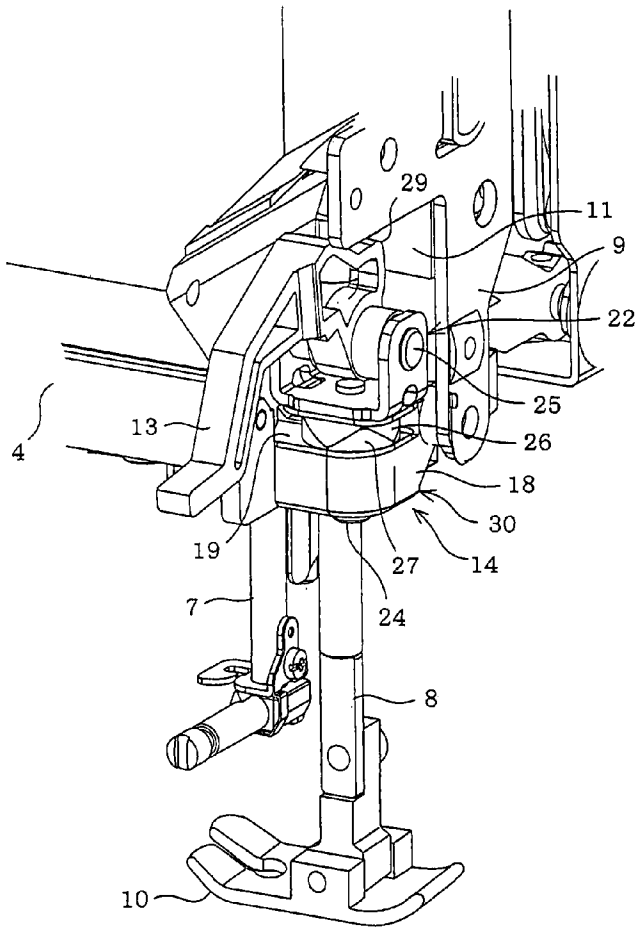
FIGS. 2A and 2B are enlarged perspective views of the presser foot lifting lever located in the surrounded space, showing descent and ascent positions of the lever respectively.
Figure 2A:
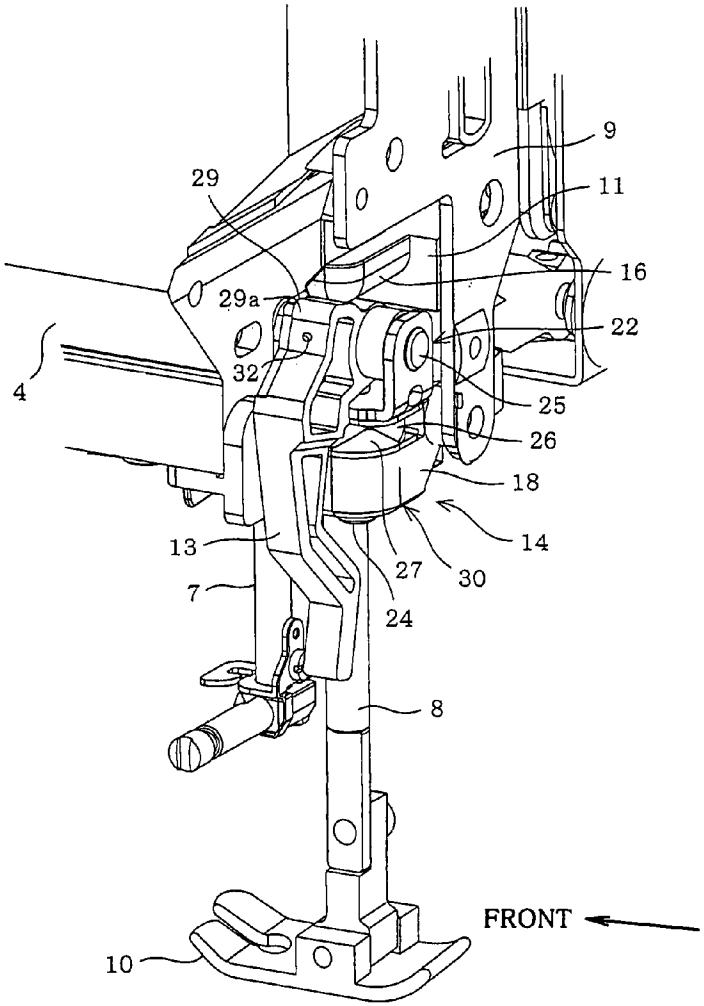
Figure 3B:
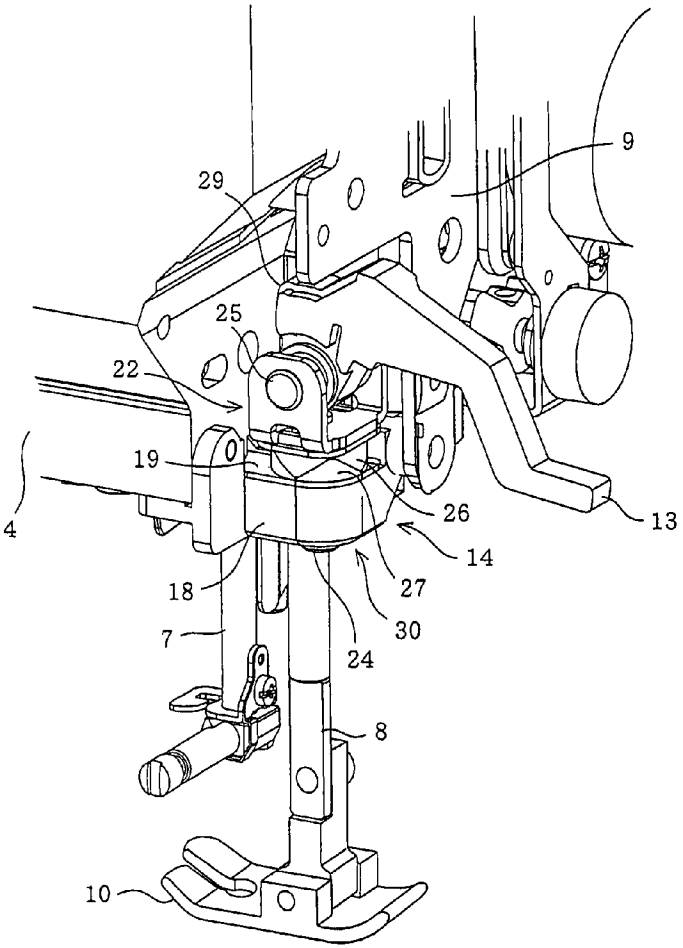
FIGS. 3A and 3B are enlarged perspective views of the presser foot lifting lever located in the rear of the head, showing descent and ascent positions of the lever respectively.
Figure 3A:
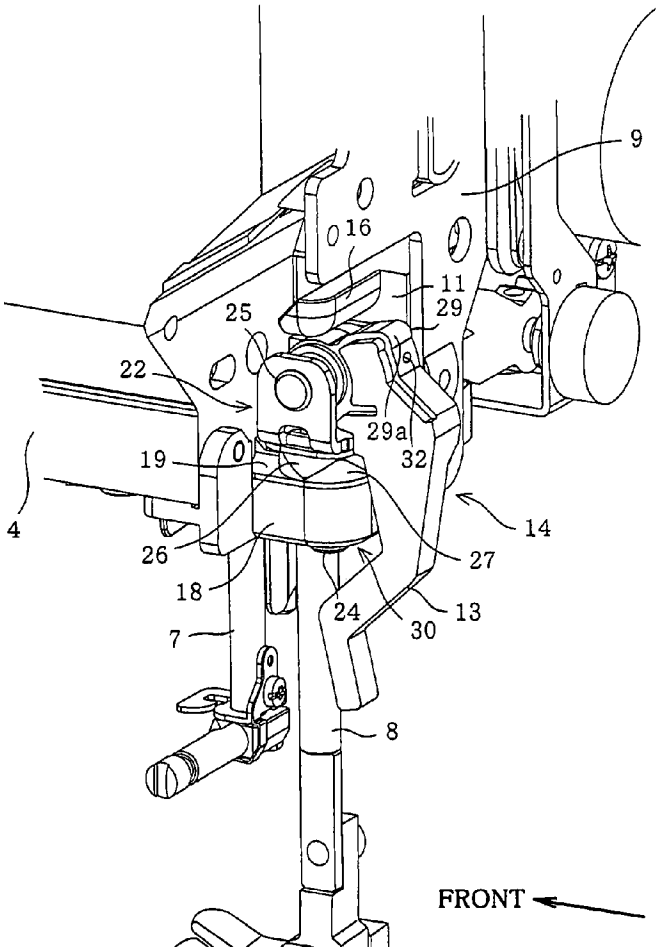

On the other hand, the head 4 includes a mounting member 18 that is located at a right rear corner of a lower portion thereof as shown in FIGS. 2A and 3A. The mounting member 18 includes a flat portion 19 facing the right rear corner of the head 4 and a guide cylinder 20 through which the guide shaft 15*b* of the presser bar bracket 11 is inserted so as to be vertically movable, as shown in FIGS. 6A and 6B. The flat portion 19 and the guide cylinder 20 are formed integrally with each other. The flat portion 19 has a cylindrical bearing 21 protruding upward and a through hole 21*a* formed through the bearing 21 and flat portion 19. The mounting member 18 constitutes a part of the sewing machine frame 9 as a frame of the sewing machine M and guides the guide shaft 15*b* of the presser bar bracket 11 in the guide cylinder 20 so that the guide shaft is lifted upward and downward.

Figure 7B:
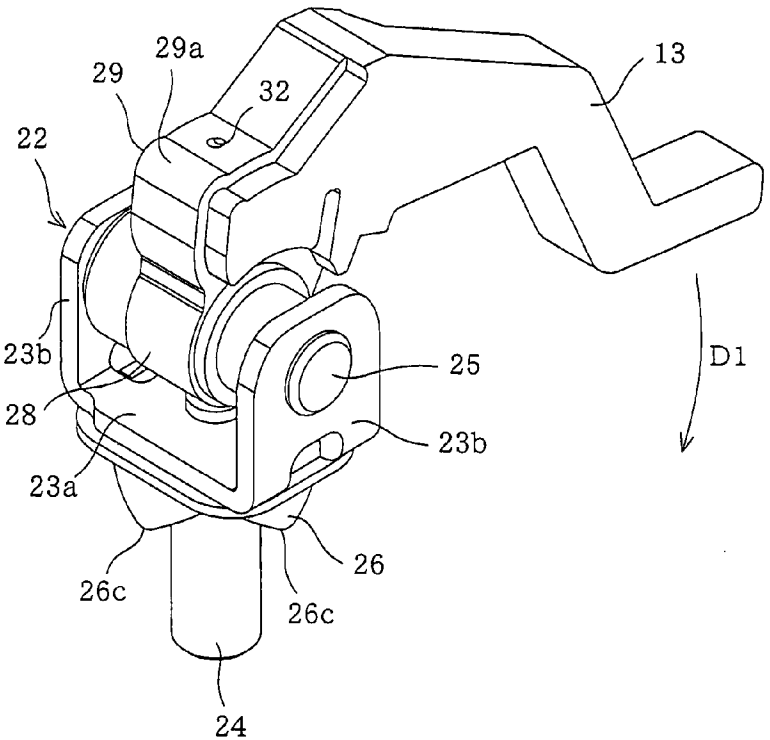
FIGS. 7A and 7B are perspective views of a lever holder in the case where the presser foot lifting lever is located at the descent and ascent positions, respectively.
Figure 7A:
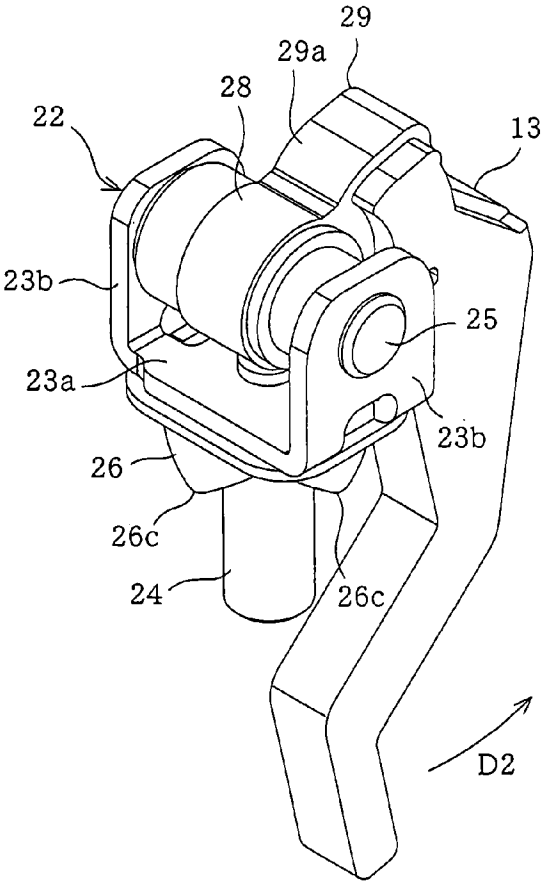

A lever holder 22 is disposed on the bearing 21 of the mounting member 18 so as to rotatably support the presser foot lifting lever 13. The lever holder 22 has a generally C-shaped bottom plate 23*a*, side plates 23*b* and a vertical shaft 24 extending downward from the bottom plate 23*a*, as shown in FIGS. 7A and 7B. The bottom plate 23*a*, side plates 23*b* and vertical shaft 24 are formed integrally with one another. The lever holder 22 further has a horizontal shaft 25 extending through holes (not shown) of the side plates 23*b*. The horizontal shaft 25 (serving as a first shaft) is directed substantially in a horizontal direction and supports the presser foot lifting lever 13 so that the lever is swingable (substantially vertically rotatable). The vertical shaft 24 (serving as a second shaft) is inserted through a through hole 21*a* of the bearing 21 so as to be directed substantially in a vertical direction. The vertical shaft 24 supports the presser foot lifting lever 13 so that the lever 13 is rotatable substantially horizontally together with the horizontal shaft 25.

Figure 8A:
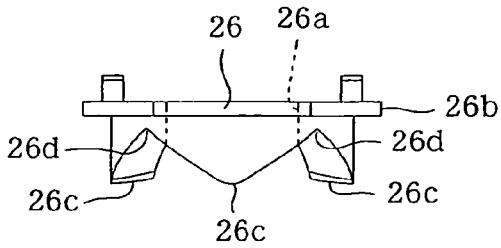
FIGS. 8A and 8B are front and bottom views of an upper cam respectively.
Figure 8B:
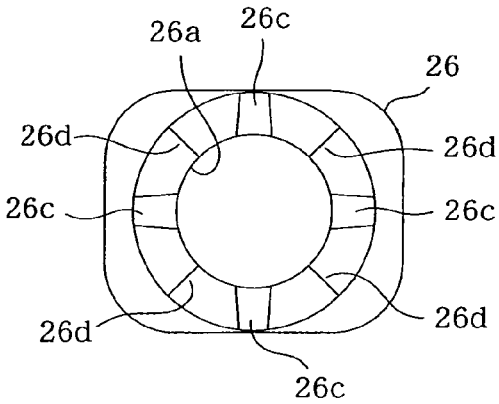

A holding mechanism is provided between the lever holder 22 and the mounting member 18 for selectively holding the presser foot lifting lever 13 at a first position located in the surrounded space F (see FIGS. 2A and 2B) or a second position located in the rear of the head 4 (see FIGS. 3A and 3B). The holding mechanism comprises a pair of cam members or upper and lower cams (second and first cams). The upper cam 26 has a mounting plate 26*b* formed with a through hole 26*a* and cam profile peaks 26*c* formed at predetermined intervals (for example, at intervals of 90 degrees) along the circumferential edge of the insertion hole 26*a* as shown in FIGS. 8A and 8B. Cam profile valleys 26*d* are formed between the cam profile peaks 26*c* in the upper cam 26. The mounting plate 26*b* is fixed to the bottom plate 23*a* of the lever holder 22 with the vertical shaft 24 being inserted through the insertion hole 26*a*.

Figure 9A:
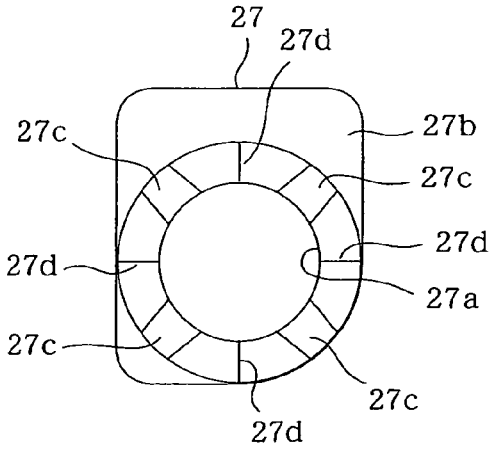
FIGS. 9A and 9B are plan and front views of a lower cam respectively.
Figure 9B:
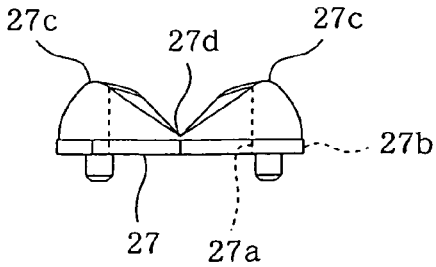
Figure 10A:
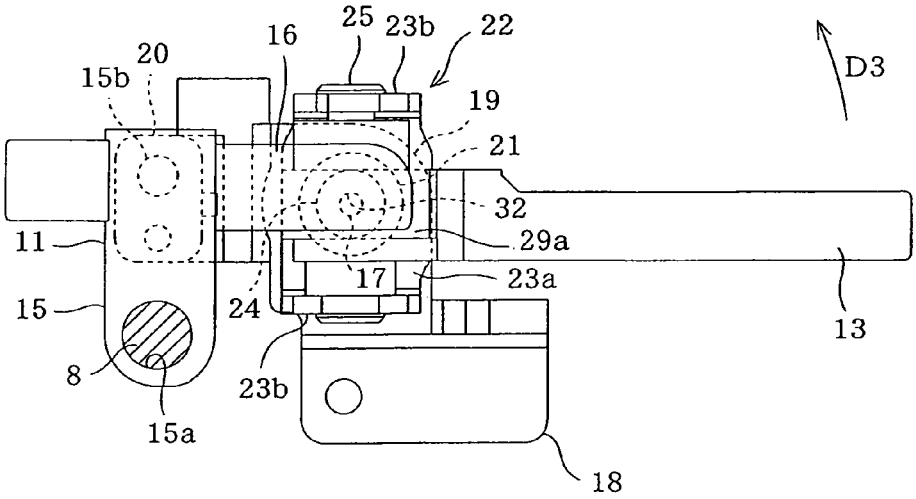
FIGS. 10A and 10B are plan views of a presser foot lifting lever located in the surrounded space and behind the head respectively.
Figure 10B:
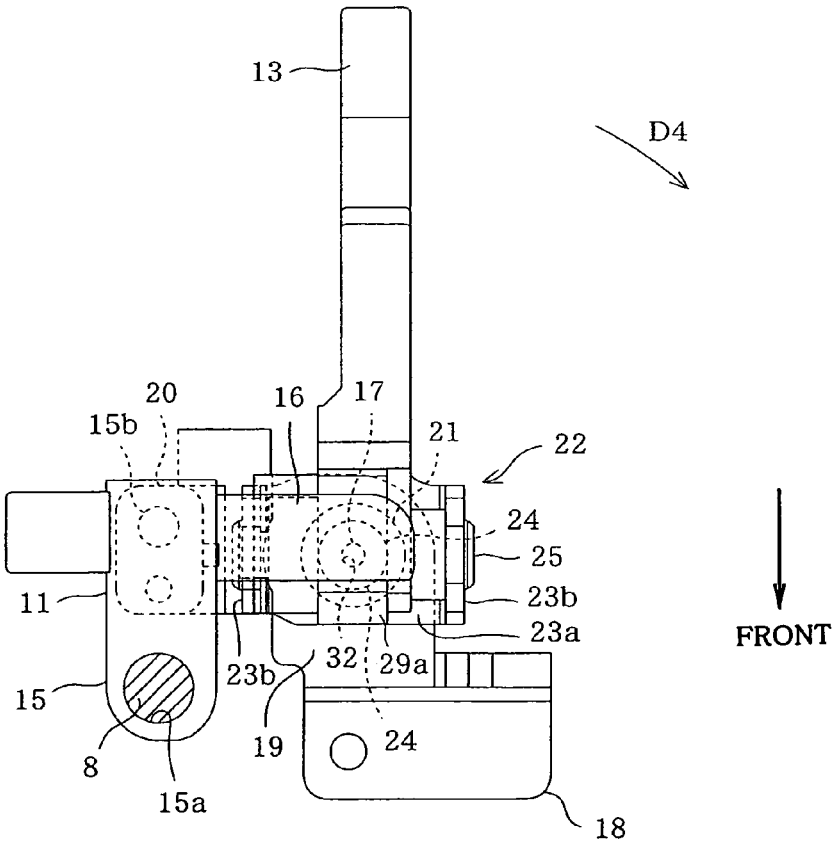

As shown in FIGS. 9A and 9B, the lower cam 27 also has a mounting plate 27*b* formed with an insertion hole 27*a*, cam profile peaks 27*c* and cam profile valleys 27*d* in the same manner as the upper cam 26. The mounting plate 27*b* of the lower cam 27 is fixed to the flat portion 19 with the bearing 21 of the mounting member 18 being inserted through the insertion hole 27*a*. Accordingly, in the case where the presser foot lifting lever 13 is rotated substantially about a horizontal axis together with the lever holder 22, the peaks 26*c* of the upper cam 26 (or valleys 26*d*) and the valleys 27*d* of the lower cam 27 (or peaks 27*c*) are adapted to engage each other when the presser foot lifting lever 13 occupies a first operation position or a second operation position.

The presser foot lifting lever 13 is formed into a general crank-shape as shown in FIGS. 7A and 7B. The presser foot lifting lever 13 has a proximal end formed integrally with a cylindrical portion 28 and a pressing bar lifting cam 29. The cylindrical portion 28 is to be inserted through a hole (not shown) of the horizontal shaft 25. The pressing bar lifting cam 29 has a bulged shape such that the cylindrical portion 28 has a larger external diameter. The cylindrical portion 28 and the pressing bar lifting cam 29 have outer peripheral surfaces serving as a cam face 29*a* against which the arm 16 of the presser bar bracket 16 abuts from above.

The presser foot lifting lever 13 is pivotally mounted on the horizontal shaft 25 inserted through the cylindrical portion 28 further mounted on the lever holder 22 so that the presser foot 10 is swung between an ascent position (see FIGS. 4B and 7B) where the presser foot 10 is lifted upward and a descent position (see FIGS. 4A and 7A) where the presser foot 10 is lifted downward. Thus, a supporting mechanism 30 serving as a support unit comprises the lever holder 22 (the vertical shaft 24 and the horizontal shaft 25) supporting the presser foot lifting lever 13, the upper cam 26, the lower cam 27 and the mounting member 18. The supporting mechanism 30 and the presser foot lifting lever 13 constitute the presser foot device 14.

The cam face 29*a* of the presser foot lifting lever 13 has a small hole-like recess 32 (an engaging portion). The recess 32 is located substantially on a central axis line of the vertical shaft 24 when the presser foot lifting lever 13 occupies the ascent position. The recess 32 disengageably engages the convex portion 17 of the presser bar bracket 11, whereby the presser foot lifting lever 13 is held at the ascent position. Accordingly, the presser foot lifting lever 13 is held at the ascent position by the press against the cam face 29*a* of the presser bar bracket 11 (or the bracket arm 16 thereof) biased by the spring 12. Furthermore, the presser foot lifting lever 13 is reliably held at the ascent position by the engagement of the recess 32 with the convex portion 17. A torsion coil spring (not shown) is provided to bias the presser foot lifting lever 13 to the lower position side (in the direction of arrow D1 in FIG. 7B). A biasing force of the torsion coil spring is naturally set at such a small value that the recess 32 and the convex portion 17 in engagement with each other are prevented from disengagement. Furthermore, the horizontal shaft 25 is provided with a generally E-shaped retaining ring (not shown). The retaining ring positions the presser foot lifting lever 13 and prevents the horizontal shaft 25 from falling off.

The operation of the presser foot device 14 will now be described with further reference to FIGS. 4A, 4B, 5A, 5B, 10A and 10B. Referring to FIG. 4A, the presser foot lifting lever 13 occupies the descent position where the distal end thereof is directed downward. In this case, the presser bar bracket 11 and accordingly the presser foot 10 are biased downward together with the presser bar 8 by the compression coil spring 12. As a result, the presser foot 10 is lifted down to a position where the presser foot 10 is in abutment with the needle plate 1*a* of the bed 1. Under the condition, workpiece cloth (not shown) on the needle plate 1*a* can be pressed by the presser foot 10. Furthermore, the presser foot lifting lever 13 occupies the first position, thereby protruding suitably into the surrounded space F (see FIG. 1). In this state, the operator causes the presser foot lifting lever 13 to pivot counterclockwise (or in the direction of arrow D2) in FIG. 4A. The cam face 29*a* of the presser foot lifting lever 13 is slid on the cam face 16*a* of the presser bar bracket 11 so that the presser bar bracket 11 is moved upward against a biasing force of the compression coil spring 12, whereupon the presser foot 10 is lifted upward together with the presser bar 8. When the presser foot lifting lever 13 is then caused to pivot to the ascent position where the lever is laterally directed (see FIGS. 2B, 4B and 10A), the cam face 29*a* of the lever is substantially horizontal thereby to press the underside of the bracket arm 16. Furthermore, the recess 32 of the lever 13 and the convex portion 17 of the presser bar bracket 11 are brought into engagement with each other when the lever 13 occupies the ascent position. In this case, since the recess 32 and the convex portion 17 are disposed so as to be located on the central axis line of the vertical shaft 24, the presser foot 10 is held at the ascent position, whereupon the workpiece cloth on the needle plate 1*a* can manually be moved. When the lever 13 occupying the ascent position is caused to pivot clockwise (or in the direction of arrow D1) in FIG. 4B, the recess 32 and the convex portion 17 disengage from each other. Furthermore, the cam face 29*a* is slid on the cam face 16*a* when the lever 13 pivots. With the sliding movement, the presser bar bracket 11 is moved downward by the biasing force of the spring 12. When the lever 13 pivots to the descent position (see FIG. 4A), the presser foot 10 is lifted downward to the descent position thereby to press the workpiece cloth.

When the workpiece cloth is treated during sewing or when the workpiece cloth is relatively large, the lever 13 occupying the aforesaid ascent position can be caused to pivot behind the head 4. More specifically, when the operator causes the lever 13 to pivot counterclockwise (or in the direction of arrow D3) in FIG. 10A, the lever 13 horizontally pivots about the recess 32 (the convex portion 17) and the vertical shaft 24 from the first position or the surrounded space F to the second position behind the head 4. With pivoting, each cam profile peak 26*c* of the upper cam 26 goes over the peak 27*c*, engaging the next valley 27*d*. As a result, a reliable detent feeling is achieved, and the upper cam 26 is held at a 90-degree pivot position. Consequently, the lever 13 can be moved to the rear of the head 4 while being held at the ascent position, that is, while the presser foot 10 and the needle plate 1*a* are separated from each other (see FIGS. 3B, 5B and 10B). Thus, even when the lever 13 has been switched to the second position, the operator can vertically move the lever 13 located behind the head 4 so that the cam face 29*a* of the lever 13 is slid on the cam face 16*b* of the presser bar bracket 11, whereby the presser foot 10 can be lifted between the ascent and descent positions (see FIGS. 3A, 3B, 5A and 5B).

As described above, the presser foot device 14 includes the supporting mechanism 30 which supports the lever 13 so that the lever 13 is switchable between the first position located in the surrounded space and the second position located at the rear of the head 4. Accordingly, the lever 13 is caused to pivot into the surrounded space F when the presser foot 10 is to be lifted upward or downward, whereupon the operability of the lever 13 can be improved. Furthermore, when the workpiece cloth is treated in the surrounded space F or when a relatively large workpiece cloth is sewn, the lever 13 is switched to the second position or behind the head 4. Consequently, the lever 13 can reliably be prevented from being touched by the operator's hand or the workpiece cloth can reliably be prevented from being caught by the lever 13. Furthermore, since the operation position of the lever 13 is switched between the first and second positions, the convenience of the presser foot device can be improved.

The lever holder 22 is provided with the horizontal shaft 25 supporting the lever 13 so that the lever 13 is movable between the ascent and descent positions and the vertical shaft 24 supporting the lever 13 so that the lever 13 is horizontally pivotable between the first and second positions together with the horizontal shaft 25. Accordingly, since the lever 13 is caused to horizontally pivot between the first and second positions together with the horizontal shaft 25, the construction for switching the lever 13 between the first and second positions can be simplified.

Furthermore, the horizontal shaft 25 is disposed so as to be directed substantially in the horizontal direction. The vertical shaft 24 is disposed so as to be directed substantially in the vertical direction. Accordingly, the horizontal and vertical shafts 25 and 24 are perpendicular to each other. Since the vertical shaft 24 is directed in the vertical direction along the presser bar 8, the supporting structure of the presser foot lifting lever 13 can be rendered suitable for the presser foot device 14 of the sewing machine M.

The lower cam 27 is fixed to the mounting member 18, and the upper cam 26 is fixed to the lever holder 22. The upper and lower cams 26 and 27 engage each other when the lever 13 occupies the first or second position. Consequently, the lever 13 can be held selectively at the first or second position. Consequently, the lever 13 can stably be operated at the first or second position. Additionally, the lever 13 can be caused to pivot smoothly between the first and second positions using contour curves of the upper and lower cams 26 and 27 (curves originally possessed by the respective cams).

The convex portion 17 is provided on the bracket arm 16 of the presser bar bracket 11, and the recess 13 is provided to be disengageably engageable with the convex portion 17, thereby holding the lever 13 at the ascent position. As a result, the lever 13 can be held so as not to be inadvertently moved due to oscillation or the like toward the descent position while the lever 13 is movable between the ascent and descent positions.

The convex portion 17 is formed on the presser bar bracket 11 so as to be located on the central axis line of the vertical shaft 24. Furthermore, the recess 32 is formed in the presser foot lifting lever 13 so as to be located on the central axis line of the vertical shaft 24 when the lever 13 occupies the ascent position. Accordingly, the lever 13 can be caused to horizontally pivot about the recess 32 (the convex portion 17) and the vertical shaft 24 while held at the ascent position. Consequently, the presser foot lifting lever 13 occupying the ascent position is allowed to stably pivot between the first and second positions, whereupon the lever 13 can be prevented from being inadvertently located at the descent position or the presser foot 10 can be prevented from inadvertently descending.

In conventional presser bar brackets, a force of the presser foot lifting lever has a point of application located on a distal end of the bracket arm. As a result, when the presser bar bracket is subjected to torsional moment, there is a possibility that the presser bar would be twisted and accordingly would be difficult to lift upward. In the above-described embodiment, however, the presser bar bracket 11 is provided with the guide shaft 15*b* and the mounting member 18 is provided with the guide cylinder 20 guiding the guide shaft 15*b*. This construction allows the bracket 11 and the presser bar 8 to be smoothly moved upward and downward, thereby overcoming the aforesaid problem of twisting.

Figure 11B:
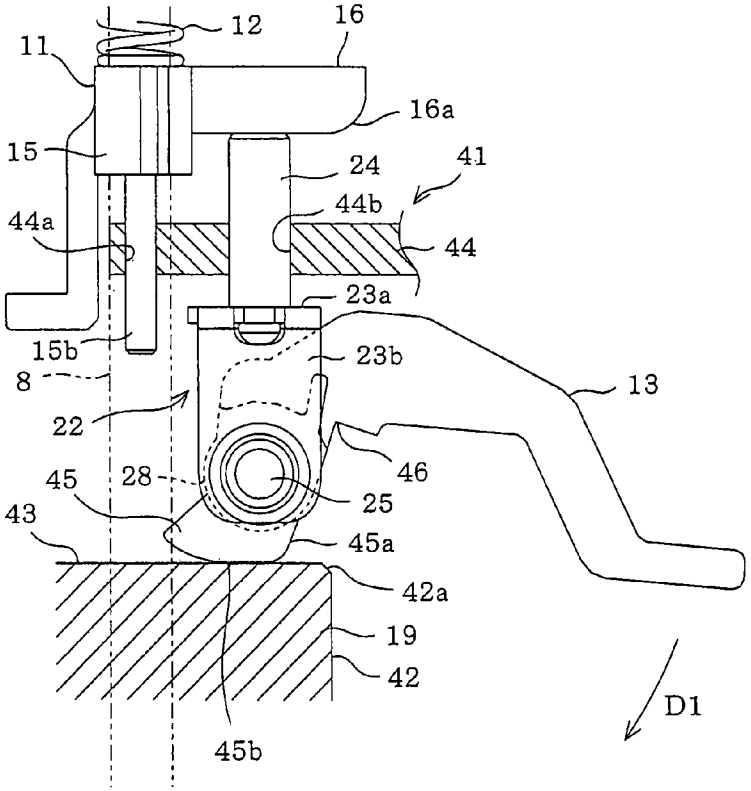
FIGS. 11A and 11B are front views of the presser foot device of a second embodiment disclosure and a part of the sewing machine near to the presser foot device in the case where the presser bar lifting device is located at the descent and ascent positions in the surrounded space respectively.
Figure 11A:
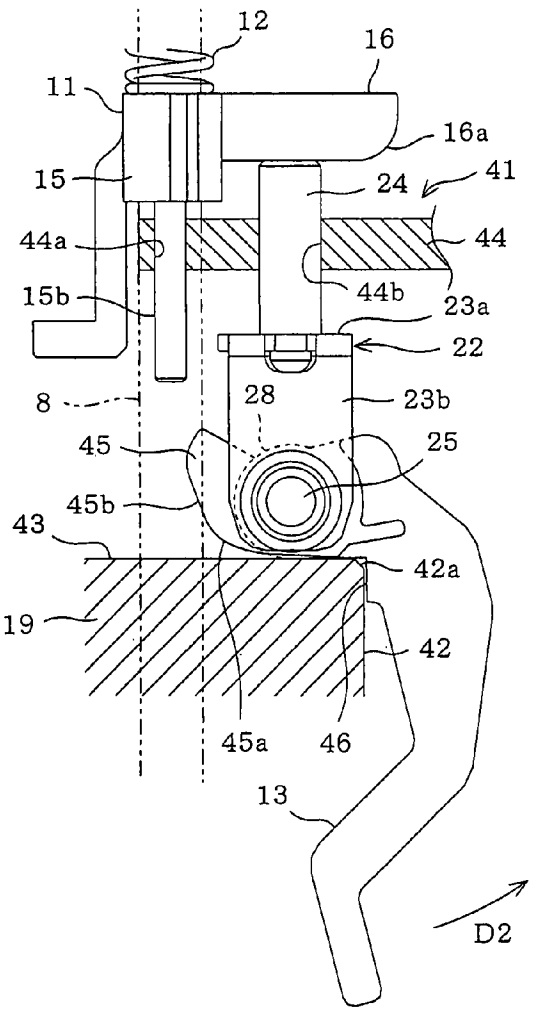

FIGS. 11A and 11B illustrate a second embodiment of the invention. The following describes only the difference between the first and second embodiments. The presser foot device 14 of the second embodiment includes a supporting mechanism 41 serving as the support unit. The supporting mechanism 41 comprises the lever holder 22 and a mounting member 42 which includes the flat portion 19 formed with a flat surface 43 and a support 44 which protrudes upward so as to be opposed to the flat portion 19. The support 44 has a through hole 44*a* through which the guide shaft 15*b* of the presser bar bracket 11 is inserted so as to be vertically movable and a through hole 44*b* through which the vertical shaft 24 of the lever holder 22 is inserted so as to be vertically movable. The vertical shaft 24 is inserted through the hole 44*b* so as to be directed substantially vertically and supports the presser foot lifting lever 13 together with the horizontal shaft 25 so that the lever 13 is pivotable substantially horizontally. In this case, the upper end of the vertical shaft 24 is adapted to abut against the arm 16 of the presser bar bracket 11, and the presser foot lifting lever 13 is adapted to abut against the mounting member 42. The sewing machine frame 9 of the head 4 is provided with a pivot limiting section which limits a pivot range of the lever 13 to a section between the first and second positions (90 degrees, for example) although the pivot limiting section is not shown.

The lever 13 has a proximal end formed with a presser bar lifting cam 45 which abuts against the flat surface 43 from above. The presser bar lifting cam 45 has an arc-shaped cam face 45*a* and a flat cam face 45*b* continuous to the cam face 45*a*. The flat cam face 45*b* is formed so as to assume a horizontal attitude (see FIG. 11B) when the lever 13 occupies the ascent position. Furthermore, the proximal end of the lever 13 is further formed with a stepped locking portion 46 extending along a corner 42*a* of the flat portion of the mounting member 42. The locking portion 46 is engageable with the corner 42*a* of the mounting member 42 thereby to hold the lever 13 at the descent position.

FIG. 11A shows the lever 13 which has been moved to the first position while occupying the descent position. When the operator causes the lever 13 to pivot counterclockwise (in the direction of arrow D2) in FIG. 11A in the shown state, the lever 13 is moved upward together with the lever holder 22 with the slide of the cam face 45*a* on the flat surface 43 of the mounting member 42. In this case, the vertical shaft 24 of the lever holder 22 abuts against the bracket arm 16 from below, whereupon the presser bar bracket 11 is moved upward against the biasing force of the spring 12. As a result, the presser foot 10 is lifted upward together with the presser bar 8 although the presser bar 8 and the presser foot 10 are not shown in FIGS. 11A and 11B. When the presser foot lifting lever 13 has pivoted to the ascent position, the cam face 45*b* is brought into contact with the flat surface of the mounting member 42 in a face-to-face contact manner, thereby holding the lever 13 at the ascent position.

When the lever 13 occupying the ascent position is caused to pivot clockwise (in the direction of arrow D1) in FIG. 11B, the cam face 45*b* and the flat surface 43 disengage from each other, whereupon the cam face 45*a* of the lever 13 is slid on the flat surface 43. As a result, the presser bar bracket 11 is moved downward by the biasing force of the spring 12. The presser foot lifting lever 13 is caused to pivot to the descent potion where the locking portion 46 engages the corner 42*a* (see FIG. 11A), so that the presser bar 8 and the presser foot 10 are lifted downward to the descent position.

The operator causes the lever 13 occupying the ascent position to horizontally pivot about the vertical shaft 24. Thus, the lever 13 can be moved to any position between the first and second positions. More specifically, although the lever 13 is held selectively at the first or second position by the upper and lower cams 26 and 27 in the first embodiment, the second embodiment differs from the first embodiment in that the lever 13 is caused to pivot so that the flat cam face 45*b* is slid on the flat surface 43. Accordingly, for example, the lever 13 is moved to the middle between the first and second positions while occupying the ascent position, whereupon the presser foot 10 can be lifted upward and downward with the lever 13 occupying the middle position.

As obvious from the foregoing, the lever 13 can be moved to any position between the first and second positions according to operator's preference, whereby the usability of the presser foot device can be improved. Furthermore, the cam face 45*b* is formed so as to assume a horizontal attitude when the lever 13 is at the ascent position thereby to be located on the central axis line of the vertical shaft 24. Accordingly, while the lever 13 occupies the ascent position, the biasing force of the spring 12 vertically acts via the bracket 11 and the lever holder 22 on the cam face 45*b*. As a result, the ascent position of the lever 13 can stably be maintained on the flat surface 43 of the mounting member 42. Additionally, when the lever 13 is moved to the second position, the workpiece cloth can reliably be prevented from being caught on the lever 13. Thus, the second embodiment can achieve the same effects as the first embodiment.

The invention should not be limited to the foregoing embodiments described with reference to the drawings. The embodiments may be modified or expanded as follows. The invention may be applied to general sewing machines provided with a presser bar 8 having a lower end with a presser foot 10 as well as the household sewing machine M. Furthermore, the horizontal and vertical shafts 24 and 25 may be disposed so as to be directed to the generally horizontal and vertical directions respectively.

The lever 13 is selectively held at the first or second position in the first embodiment. However, the invention should not be limited to the construction. The number of each of cam profile peaks 26*c* and 27*c* may be increased regarding the upper and lower cams 26 and 27. For example, the peaks may annularly be arranged at intervals of 10 degrees, whereupon clicking can be obtained at a plurality of times, for example, at nine times for every 10 degrees with pivot of the lever 13 between the first and second positions. In addition, the lever 13 can selectively be held at one of a plurality of positions (10 positions, for example) including the first and second positions.

In each foregoing embodiment, the sewing machine M may be provided with an automatic presser foot lifting mechanism which automatically lifts the presser foot by electric drive without operation of the lever 13 when one of the operation switches 5 is operated. When the presser foot 10 is lifted using the automatic presser foot lifting mechanism, the lever 13 may normally be kept at the second position so that the presser foot 10 can be prevented from being blocked by the lever 13. When the operator wishes to accurately adjust a sewing start location of the workpiece cloth, the sewing machine is switched to a manual mode so that the lever 13 is manually operated to lift the presser foot 10.

In the second embodiment, the upper and lower cams 26 and 27 may be provided between the lever holder 22 and the support 44 of the mounting member 42 so that the lever 13 can selectively be held at the first or second position as in the first embodiment. Furthermore, a convex portion serving as the engaged portion and corresponding to the convex portion 17 in the first embodiment may be provided on the flat surface 43 of the mounting member 42 in the second embodiment. A recess serving as the engaging portion which engages the convex portion may be provided in the cam face 45*b* of the lever 13. As a result, the ascent position of the lever 13 can be held further reliably. Additionally, in each foregoing embodiment, the recess may serve as the engaged portion, and the convex portion may serve as the engaging portion.

The foregoing description and drawings are merely illustrative of the principles of the present disclosure and are not to be construed in a limiting sense. Various changes and modifications will become apparent to those of ordinary skill in the art. All such changes and modifications are seen to fall within the scope of the disclosure as defined by the appended claims.

What is claimed is:

1. A presser foot device for a sewing machine which includes a presser bar mounted on a head provided at a distal end of an arm and having a lower end provided with a presser foot, the presser foot device lifting the presser foot upward and downward together with the presser bar, the presser foot device comprising:

a first shaft;

a support unit configured to support the first shaft; and a presser foot lifting lever configured to move the presser foot upward and downward, the presser foot lifting lever being rotatably connected to the support unit by the first shaft, wherein the support unit is rotatable between a first position where the presser foot lifting lever is located below the arm of the sewing machine and a second position where the presser foot lifting lever is located behind the head of the sewing machine.

2. The presser foot device according to claim 1, further comprising a second shaft for supporting the support unit, wherein the support unit is rotatably attached to the second shaft, and the support unit is caused to pivot between the first position and the second position by the second shaft.

3. The presser foot device according to claim 2, wherein the first shaft is disposed so as to be directed substantially in a horizontal direction, and the second shaft is disposed so as to be directed substantially in a vertical direction.

4. The presser foot device according to claim 1, wherein the support unit includes a holding mechanism which holds the presser foot lifting lever selectively at the first or second position.

5. The presser foot device according to claim 4, wherein the holding mechanism includes a first cam fixed to a frame of the sewing machine and a second cam which is provided so as to be operated in association with movement of the presser foot lifting lever between the first and second positions, the second cam engaging the first cam at the first and second positions.

6. The presser foot device according to claim 2, wherein the first shaft supports the presser foot lifting lever so that the presser foot lifting lever is swingable between an ascent position where the presser foot is lifted upward and a descent position where the presser foot is lifted downward and the second shaft supports the presser foot lifting lever so that the presser foot lifting lever is rotatable between the first position and the second position together with the first shaft substantially horizontally.

7. The presser foot device according to claim 6, wherein the sewing machine further includes a presser bar bracket which is fixed to the presser bar and is provided with an engaged portion, and the presser foot lifting lever is provided with an engaging portion that is disengageably engageable with the engaged portion, thereby holding the presser foot lifting lever at the ascent position.

8. The presser foot device according to claim 7, wherein the engaging portion is disposed so as to be located substantially on a central axis of the second shaft when the presser foot lifting lever is located at the ascent position.

9. A sewing machine comprising:

an arm having a distal end provided with a head;

a presser bar mounted on the head and having a lower end provided with a presser foot;

a presser foot device lifting the presser foot upward and downward together with the presser bar, the presser foot device comprising:

a first shaft;

a support unit configured to support the first shaft; and a presser foot lifting lever configured to move the presser foot upward and downward, the presser foot lifting lever being rotatably connected to the support unit by the first shaft, wherein the support unit is rotatable between a first position where the presser foot lifting lever is located below the arm of the sewing machine and a second position where the presser foot lifting lever is located behind the head of the sewing machine.

10. A presser foot device for a sewing machine which includes a presser bar mounted on a head provided on a distal end of an arm and having a lower end provided with a presser foot, the presser foot device lifting the presser foot upward and downward together with the presser bar, the presser foot device comprising:

a support unit comprising:

a mounting member attached to the head;

a lever holder rotatably connected to the mounting member;

a first shaft;

a presser foot lifting lever configured to move the presser foot upward and downward, wherein the presser foot lifting lever is rotatably connected to the lever holder by the first shaft; and the support unit is rotatable between a first position where the presser foot lifting lever is located below the arm of the sewing machine and a second position where the presser foot lifting lever is located behind the head of the sewing machine.

11. The presser foot device according to claim 10, wherein the support unit further comprises a second shaft, and the second shaft is rotatably connected to the mounting member and the lever holder.

* * * * *